United States Patent [19]

Dickinson

[11] Patent Number: 4,844,653

[45] Date of Patent: Jul. 4, 1989

[54] CABLE-BEAM TRAFFICWAY BARRIER

[76] Inventor: Harry D. Dickinson, 1681 Larco Way, Glendale, Calif. 91302

[21] Appl. No.: 65,558

[22] Filed: Jun. 23, 1987

[51] Int. Cl.[4] ..... E01F 13/00

[52] U.S. Cl. ..... 404/6; 49/9; 49/34

[58] Field of Search ..... 404/6; 49/9, 34, 49; 256/1, 13.1; 14/51, 53

[56] References Cited

U.S. PATENT DOCUMENTS

| | | | |
|---|---|---|---|
| 1,296,658 | 3/1919 | Hansen | 49/9 X |
| 1,705,828 | 3/1929 | Searles | 49/9 |
| 1,709,344 | 4/1929 | Gage et al. | 49/9 |
| 1,848,516 | 3/1932 | Davison | 49/9 |
| 1,886,719 | 11/1932 | Oaks et al. | 49/9 X |
| 2,098,284 | 11/1937 | Fraser | 49/9 X |
| 2,311,967 | 2/1943 | Sawyer | 49/9 |
| 2,337,626 | 12/1943 | Sawyer | 256/1 |
| 2,774,325 | 12/1956 | Budde | 256/13.1 X |
| 4,097,170 | 6/1978 | Dickinson | 404/6 |
| 4,158,514 | 6/1979 | Dickinson | 404/6 |
| 4,318,079 | 3/1982 | Dickinson | 340/127 |
| 4,490,068 | 12/1984 | Dickinson | 404/6 |
| 4,576,508 | 3/1986 | Dickinson | 404/6 |
| 4,624,600 | 11/1986 | Wagner et al. | 404/6 |
| 4,759,655 | 7/1988 | Gorlov | 404/6 |
| 4,780,020 | 10/1988 | Terio | 404/6 |

FOREIGN PATENT DOCUMENTS

| | | | |
|---|---|---|---|
| 1658667 | 12/1970 | Fed. Rep. of Germany | 256/13.1 |
| 417279 | 11/1910 | France | 49/9 |

*Primary Examiner*—Jerome W. Massie, IV
*Assistant Examiner*—Matthew Smith
*Attorney, Agent, or Firm*—William H. Maxwell

[57] ABSTRACT

A semaphore type trafficway barrier for arresting vehicles, and comprised of spaced posts at opposite sides of the trafficway, one a pivot post disposed on a vertical axis and with a yieldable mounting rotatable plate on the post to carry a beam to swing between an open ineffective position to a closed effective position as well as to yield to impact, and characterized by a cable anchored to the pivot post and carried by the beam with an end engaged over a bit on the other post at the opposite side of the trafficway.

6 Claims, 4 Drawing Sheets

CABLE-BEAM TRAFFICWAY BARRIER

BACKGROUND

This invention relates to anti terrorist barriers capable of stopping the movement of vehicles unauthorized to enter through a trafficway. A vehicle moving toward such a barrier has a certain kinetic energy which is a measure of the hitting power is possesses. This kinetic energy is calculated from the vehicle weight and velocity, and upon impact with such a barrier the kinetic energy is then converted into heat, sound and deformation of the vehicle, and with this invention in deformation also of the barrier. In actual practice, the total energy of dissipation depends upon varying factors prevailing at the moment of impact, all of which need not be detailed here. However, for example, a vehicle moving at 50 mph has five times as much kinetic energy as it would moving at 10 mph; or for example an armored car weighing thirty times as much as a small passenger car and moving at 10 mph would have less kinetic energy than said passenger care moving at 60 mph. The stopping capacity of the barrier herein disclosed is designed, for example, to stop a 10,000 pound vehicle impacting at 27 mph, or a 6,000 pound vehicle impacting at 34.5 mph, it being a general object of this invention to provide a yielding barrier, characterized by a hidden cable within a beam retractably extending visibly across a trafficway.

This barrier is a semaphore type arm in the form of a visible beam that extends across a trafficway, between anchor blocks to which it is attached in closed and effective position. In the open ineffective position the beam is detached from one block and extends away from the other block. Accordingly, the two blocks are at opposite sides of the trafficway, it being an object of this invention to tie these two blocks together, in the effective position, by means of the beam and in a manner which is inseparable. In practice, therefore, the beam is characterized by a flexible cable of substantial strength which yields to vehicle impact dependent upon the magnitude of kinetic energy applied. Upon slight impact the cable yields very little. However, upon great impact the cable yields a substantial amount and flexibly conforms to the vehicle configuration while arresting its motion. The cable then becomes a snare attached to spaced anchor blocks, each in the form of a bollard or the like.

It is an object of this invention to provide a beam support for the aforesaid cable, by which it is retractably carried to fasten between the two anchor blocks. The beam is tubular, so to enclose and hide the cable, and it is adjustable as to length so as to accommodate the distance between the two anchor blocks. In practice, there is an extension tube that is expendable and which telescopes into a yoke tube that is swiveled so as to swing away from a transverse position. The extension tube is initially straight and carries the thimbled end of the cable into alignment with an anchor block to which it is detacheable.

It is an object of this invention to provide means that pivots the cable anchor beam at a first side of the trafficway, to swing away from a transverse effective position. It is also an object of this invention to provide means that swivels the cable carrying beam at a first side of the trafficway, to rotate in a horizontal plane during vehicle impact. In practice, parts of this mounting, at what will be termed the pivot block, are frangible so as to permit horizontal rotation.

It is another object of this invention to provide means that anchors the cable and beam at a second side of the trafficway, to rotate in a horizontal plane during vehicle impact. In practice, the cable end is positioned by the beam to engage over a bit onto which it is latched, and preferably padlocked.

It is still another object of this invention to provide counterbalancing of the beam and cable, with spring compensation of movement to and from a normal horizontal position and a raised position of the beam and cable, where they are arrested.

SUMMARY OF THE INVENTION

This cable-beam trafficway barrier is cost effective and efficient for the purpose intended. Heavy steel cable is hidden within the tubular beam and adjusted to the distance between spaced concrete blocks, one at each side of the trafficway. The first block is the pivot block that mounts a pivot plate to which a yoke is rotatably attached to swing away from the effective position, and also to yield to impact through frangible bearing means. The second block is the anchor block that secures the cable end carried by the beam into and out of the effective position. The cable is pinned to the pivot plate and is latched to the anchor block bit. A feature of this barrier is its adjustability and replacement of parts expected to be damaged under severe impact. However, slight impacts are not damaging thereto, the expendable and frangible parts being relatively inexpensive and easy to replace.

The foregoing and various other objects and features of this invention will be apparent and fully understood from the following detailed description of the typical preferred form and application thereof, throughout which description reference is made to the accompanying drawings.

THE DRAWINGS

Figure 1:
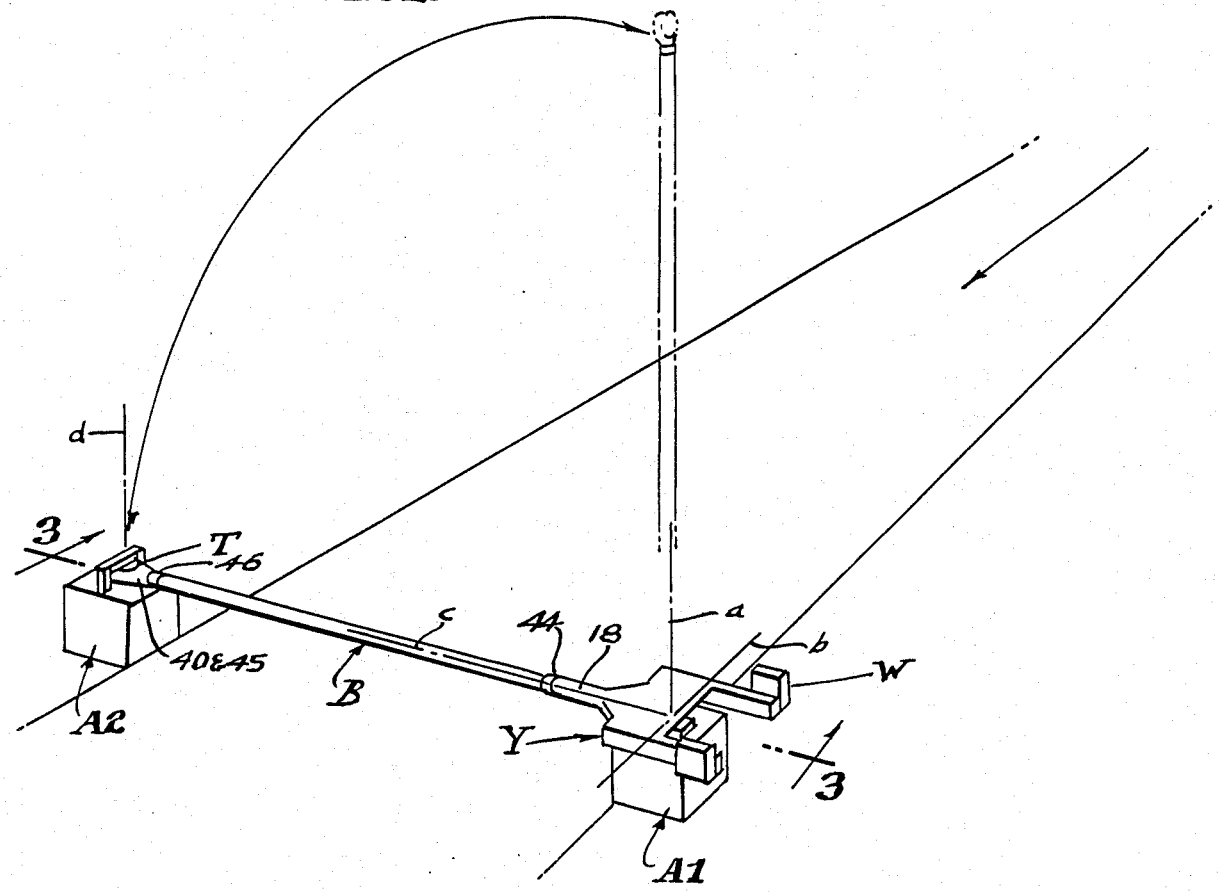
FIGS. 1 and 2 are perspective views of a first embodiment of the trafficway barrier installation, FIG. 1 showing the barrier in a closed position preparatory to arresting traffic, and FIG. 2 showing the barrier after a vehicle has been arrested.
Figure 2:
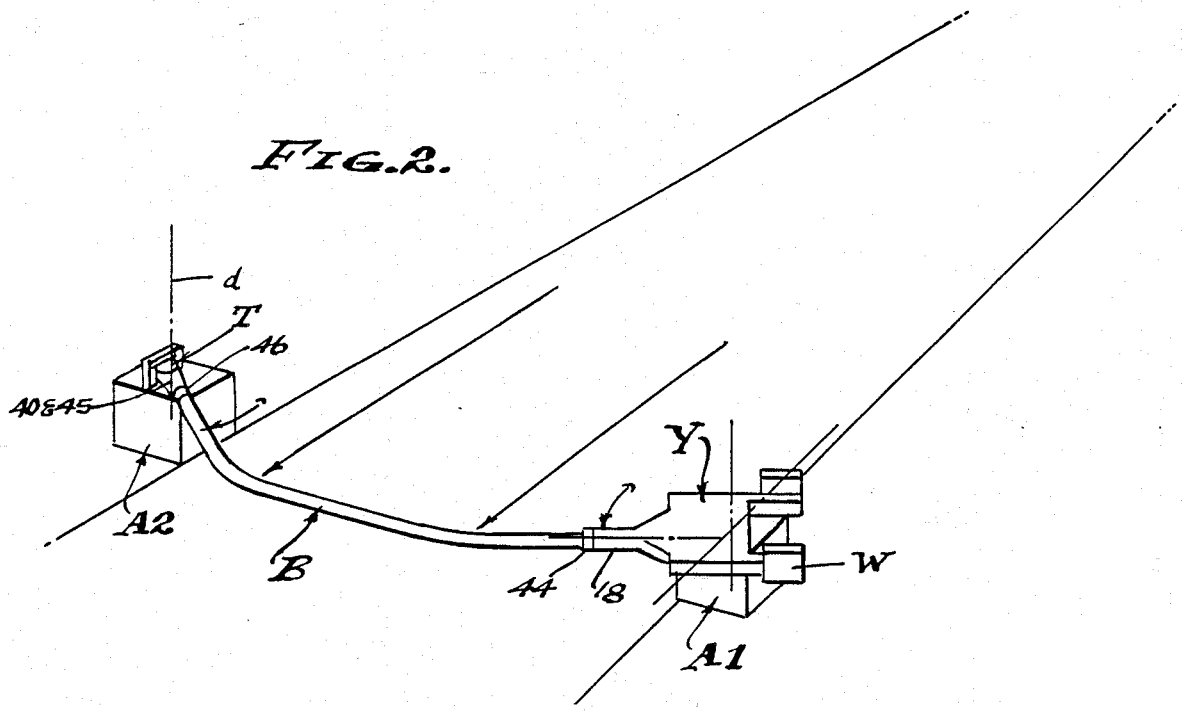
Figures 3, 5, 7:
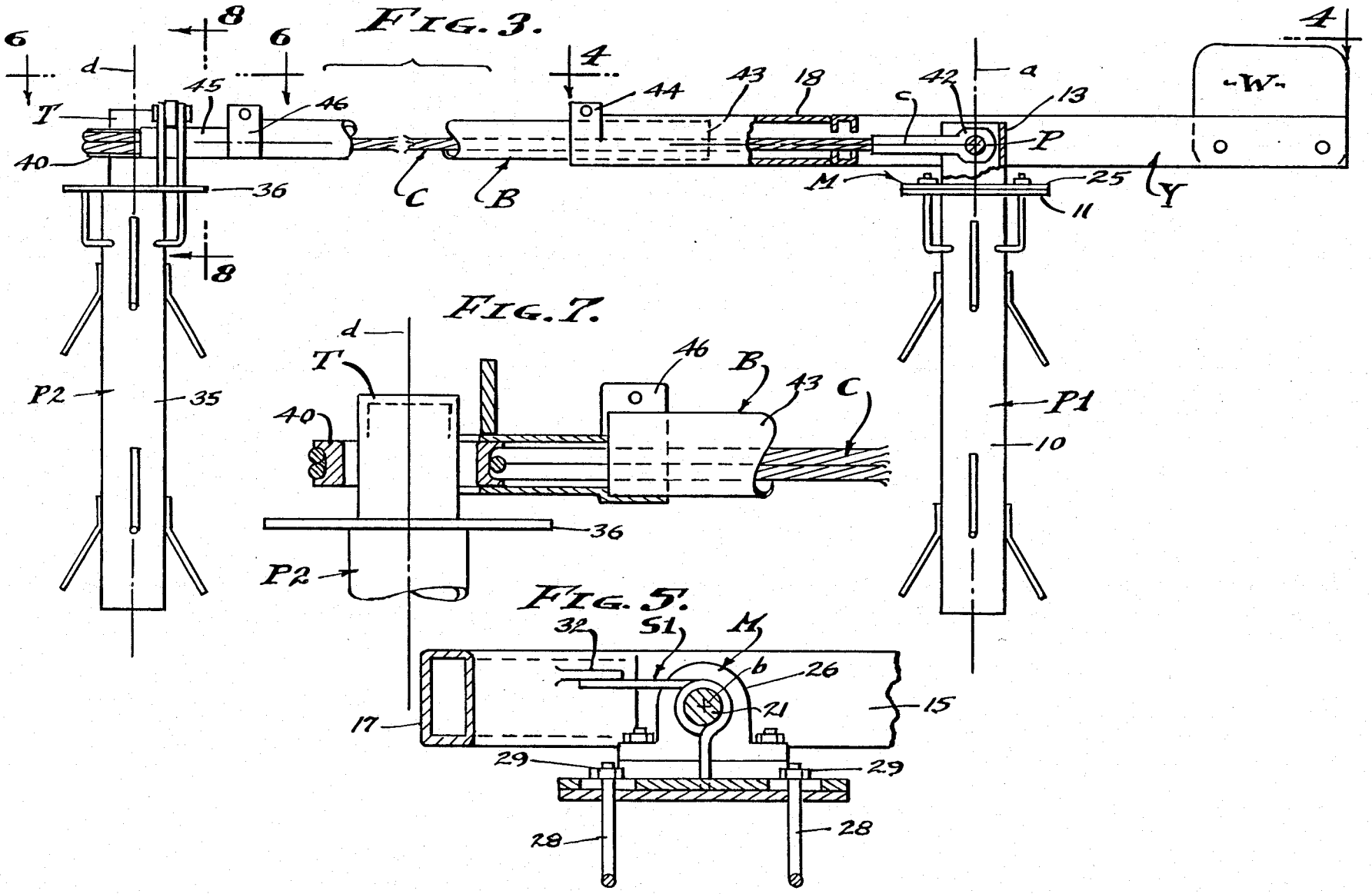
FIG. 3 is a view of the barrier parts taken as indicated by line 3—3 on FIG. 1.
FIG. 5 is an enlarged fragmentary view taken as indicated by line 5—5 on FIG. 4.
FIG. 7 is an enlarged fragmentary view taken as indicated by line 7—7 on FIG. 6.
Figure 4:
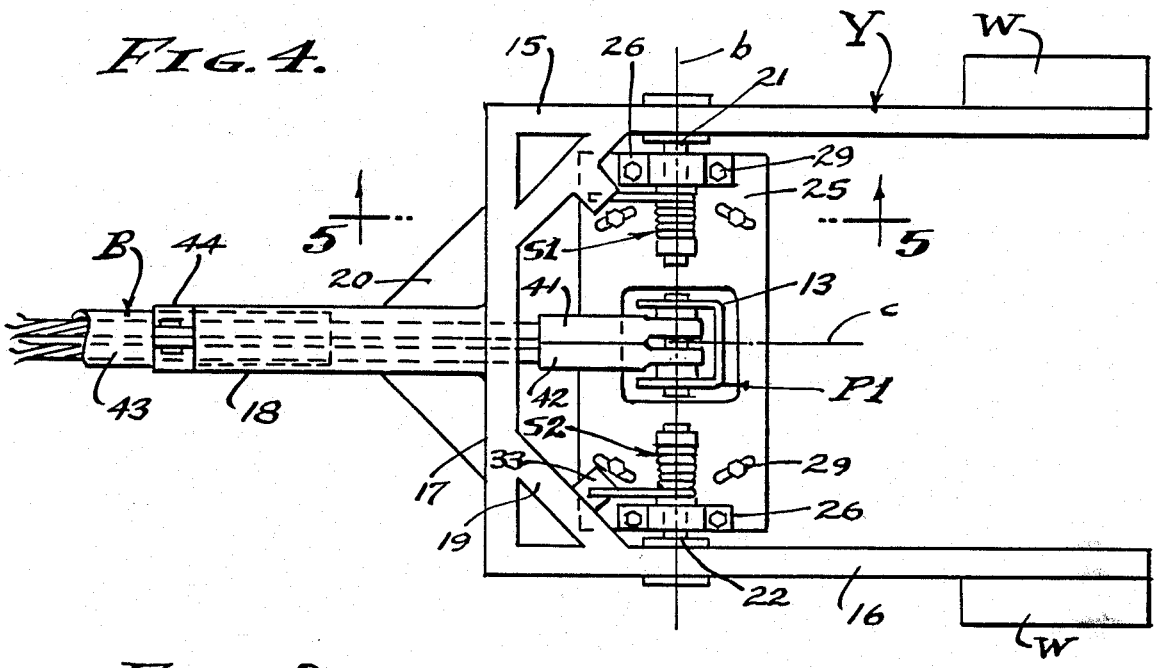
FIG. 4 is a view taken as indicated by line 4—4 on FIG. 3.
Figure 6:
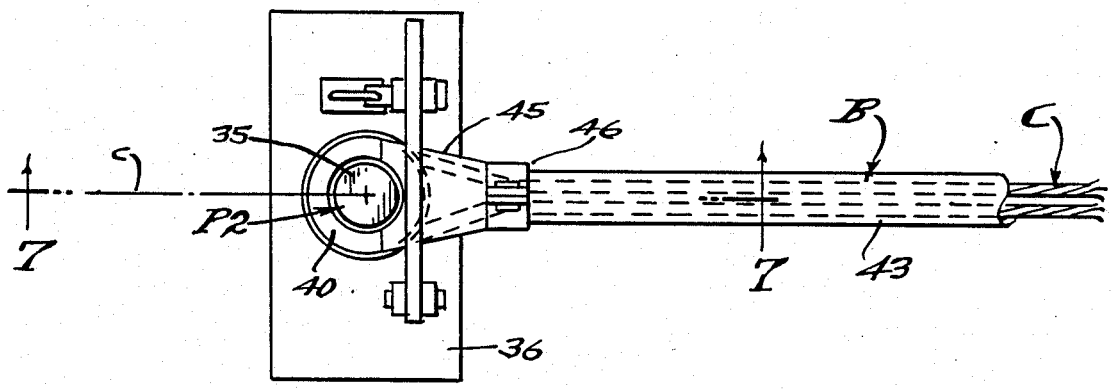
FIG. 6 is an enlarged fragmentary view taken as indicated by line 6—6 on FIG. 3.
Figure 8:
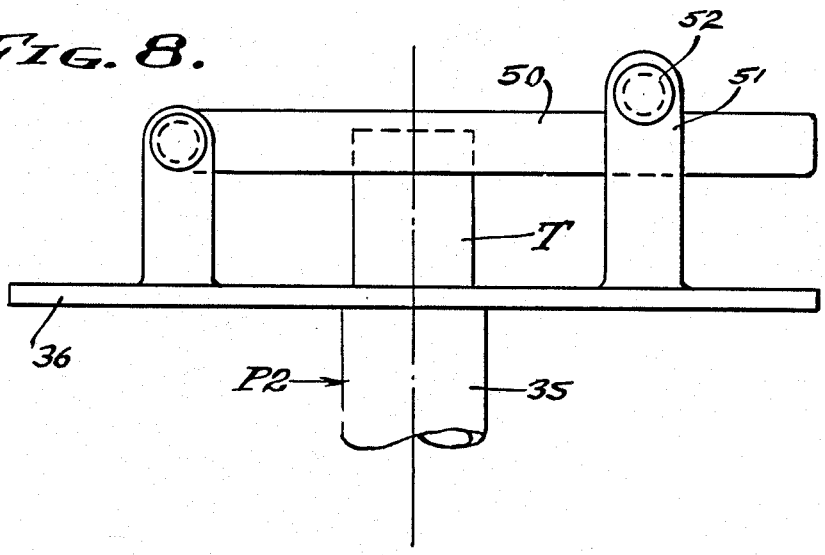
FIG. 8 is an enlarged fragmentary view taken as indicated by line 8—8 on FIG. 3.
Figure 9:
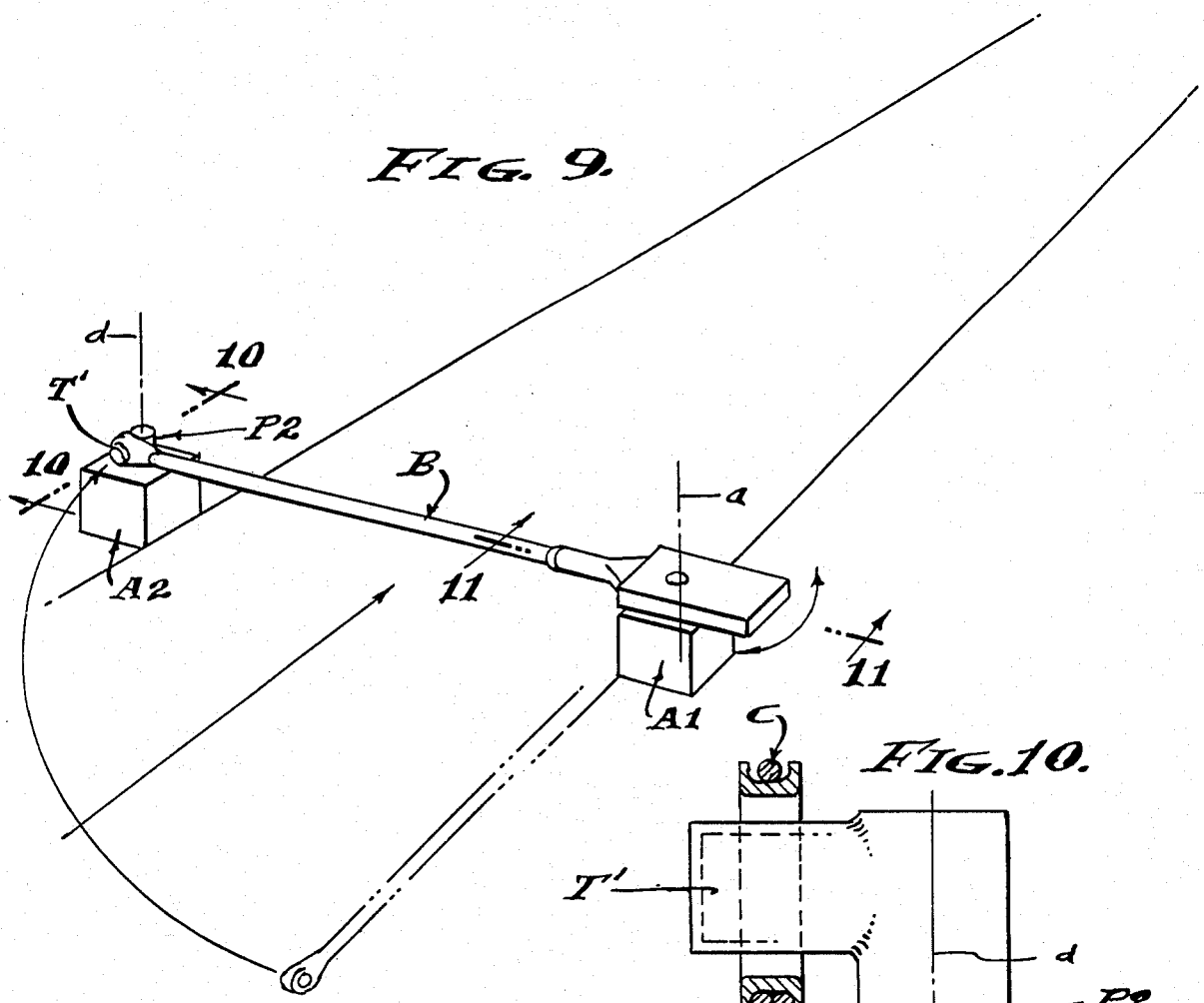
FIG. 9 is a perspective view simialr to FIG. 1 and shows a second embodiment of the trafficway barrier, showing the barrier in a closed position preparatory to arresting traffic.
Figure 11:
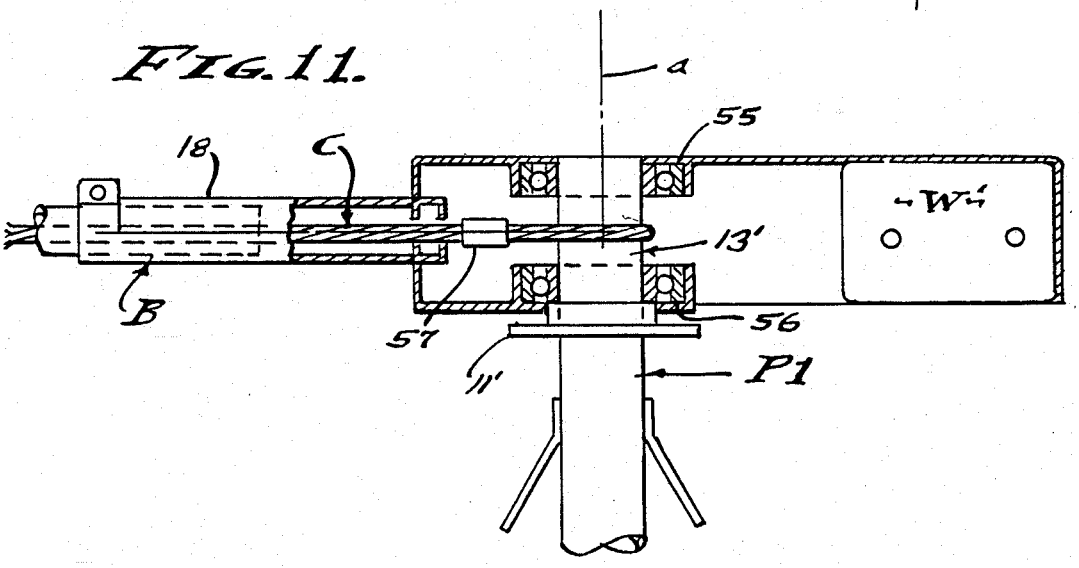

And, FIG. 11 is an enlarged fragmentary view taken as indicated by line 11—11 on FIG. 9.

PREFERRED EMBODIMENT

This invention is characterized by a semaphore type arm, in the form of a beam B that carries a cable C between anchor blocks A1 and A2 at opposite sides of a trafficway. The beam is swiveled at anchor block A1 by means at a pivot post P1, and is detacheable to anchor block A2 by means at a bit post P2. A feature of this invention is that the cable C is flexible and that a portion of the beam is destructable and expendable, both two posts P1 and P2 permitting horizontal rotation, or angular displacement, of the beam and cable extending therebetween when yielding to vehicle impact. Accordingly, pivot post P1 has mounting means M to which the beam B is carried by a yoke Y and to which the cable is received by a pin P. And, the post P2 has a bit T to which the cable C is detacheably secured in the effective position. Also provided are weights W for counter-balancing the beam and cable, and springs S1 and S2 for damping movement of the beam and cable into the horizontal and vertical positions.

The anchor blocks A1 and A2 are alike, so that a description of one will suffice for both. It is preferred that the blocks A1 and A2 be made of reinforced concrete, burried at least twenty four inches below grade and extending twenty four inches above grade. In practice, these two anchor blocks are twenty four inches square and are poured into suitable forms (not shown) with steel bar reinforcement (as indicated) and the posts P1 and P2 in place. The top planes of the two anchor blocks are, or as nearly as possible, coplanar; adjustment thereto being made in the beam B and mounting means M as later decribed.

The pivot post P1 is a tubular column 10 disposed on a vertical axis a and terminating in an anchor 13 that projects a short distance above a mounting plate 11 engageably overlying the planar top of the anchor block A1 to adjustably support the mounting means M as later decribed.

The yoke Y is a frame that embraces the anchor block A1 and carries the beam B and the counterbalance weights W. As shown, the yoke Y is comprised of spaced arms 15 and 16 joined by a header 17 from which the two arms extend rearwardly and clear of the opposite sides of the anchor block A1. A socket member 18 projects forwardly from the center of the header to carry the beam B on an axis c intersecting and coincidental with the intersection of axis a with a transverse axis b. Diagonal trusses 19 and 20 reinforce the frame of the yoke Y, all members of which are rugged and substantial. Trunnions 21 and 22 project inwardly from arms 15 and 16 respectively and stop short of the projecting anchor 13, said trunnions being on a common axis coincidental with the transverse axis b when installed on the mounting means M next described.

The mounting means M is comprised of a rotatably adjustable plate 25 that coextensivley overlies the plate 11 and through which the anchor 13 projects so as to secure the cable C, and to which pillow blocks 26 and 27 are mounted to carry the yoke Y on the pivotal axis b. The anchor 13 projects through an opening in the plate 11 and has bearing openings 14 to receive the cable pin P disposed on the horizontal and transverse axis b intersecting the aforesaid axis a. The axis b is also coincidental with the pivotal axis of the mounting means M which permits raising and lowering of hte beam B carried by the yoke Y.

Rotatable adjustment of plate 25 is by means of studs 28 projecting from the corners of plate 11 engaged through slots in plate 25 and secured by lock-nuts 29. The degree or angular displacement of the adjustment is limited and/or restricted as shown; by the arcuate lengths of the slots. A forwardly disposed opening in the tubular anchor-post accommodates the adjacent ends of the cable C. And, the pillow blocks 26 and 27 can be any suitable bearing blocks and are preferably a commercial grade anti-friction bearing with a cast iron or steel housing which will destruct upon severe impact loads; all without overstressing the cable and remaining mounting structure and frame of the yoke Y. The pillow blocks 26 and 27 are therefore replaceable and secured to the plate by suitable screw fasteners.

The trunnions 21 and 22 pass through the pillow blocks 26 and 27 during assembly of said blocks upon the plate 25, and said trunnions extend inwardly from said blocks to carry the damping springs S1 and S2 respectively. As shown, the spring S1 is anchored at one end into plate 25 and its other end engages under a tab 32 of the yoke frame so as to apply an increased lifting force as the beam B and yoke Y are lowered to the horizontal effective position. And, the spring S2 is anchored at one end into plate 25 and its other end engages over a tab 33 of the yoke frame so as to apply an increased depressing force as the beam B and yoke Y are raised to the vertical ineffective position. Thus, the yoke Y carrying the cable C and beam B is damped upon reaching its opposite extreme positions.

The weights W are carried by rearward extensions of the arms 15 and 16 so as to be cantilevered and thereby counterbalance the weight of the cable C and beam B later described.

The bit post P2 is a tubular column 35 disposed on a vertical axis d and terminating in a plate 36 engageably overlying the planar top of the anchor block A2, the upper end portion of the post projecting a short distance above the plate in the form of the bit T to which the outer end of the cable C is detacheable. As shown, the bit T is a cylindrical extension of the bit post P2 over which the outer end of cable C is engaged.

The cable C can take various configurations and is preferably a single length of high tensile steel cable having substantial flexibility, so as to be easily looped or doubled over a circular thimble 40 at the outer end of the beam B. The opposite ends of the cable C terminate in swedged fittings with eyes 41 and 42 that are anchored into aligned openings through the anchor 13, by the cable pin P. The pin P is secured in position by spaced collars held by set screws.

The beam B is a deformable thin walled tube 43 through which the cable C extends from pin P internally to loop around the thimble 40. The inner end of tube 43 telescopes into the yoke socket member 18, to which it is held by a clamp 44 and a flared fitting 45 is secured to the outer end of the tube 43, as by a clamp 46, and carries the thimble so that its cylinder form is aligned on a vertical axis to receive the bit T. In accordance with this invention, the beam tube 43 is adjustable both longitudinally and rotatably in the yoke member 18, so as to properly locate the thimble axis with the bit axis d. The clamp 44 secures this adjusted position.

When the cable C and beam B are lowered into the effective position, a pivoted latch bar 50 is lowered over the thimble 40 and/or fitting 45 and secured to a clevis 51 or the like, as by means of a pin 52, or preferably a padlock, and thereby made secure. As shown therefore, the cable C extends between the pivot post P1 and bit post P2, above grade in a horizontal position to intercept any vehicle attempting to penetrate the trafficway.

Figure 10:
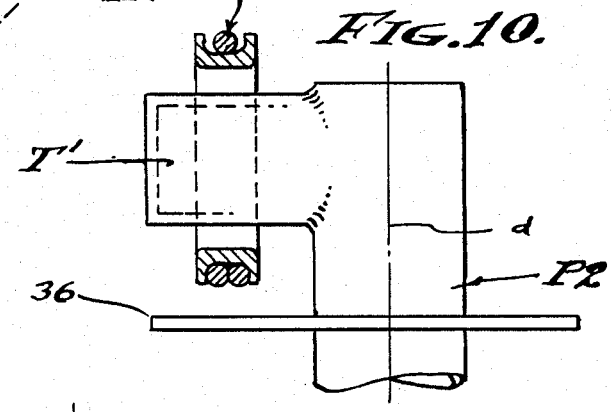
FIG. 10 is an enlarged fragmentary view taken as indicated by line 10—10 on FIG. 9.

The semaphore type barrier hereinabove described and shown in FIGS. 1–8 of the drawings is the preferred embodiment of this invention. However, a more basic and simplified embodiment is shown in FIGS. 9–11 as will now be described. In this second embodiment the opening and closing movement of the beam B and cable C is horizontal rather than vertical. That is, the beam and cable swing on the vertical axis a of post P1, so as to close with or separate from the post P2. Accordingly the anchor 13′ projects above the mounting plate 11′ and is embraced by bearing means comprised of upper and lower bearings 55 and 56 that carry the beam B on the vertical axis a of rotation common to both embodiments herein disclosed. The bearing means supports a frame from which the socket member 18 projects to receive the beam B, as hereinabove described, and which carries a counterbalance W′. The end or ends of the cable C are secured to the anchor 13′ as by a loop surrounding the anchor and held by swedged clamps 57 or the like, to adjust the cable length. As shown, the bearings 55 and 56 embrace the looped end or ends of the cable secured around the anchor 13′ of post P1. At the bit post P2, the bit T′ is horizontally disposed a short distance above the plate 36 and is preferably disposed so as to face toward the oncoming vehicle traffic, and to which the outer end of the cable C is detacheable as hereinabove described. However, the outer cable end can be attached to a bit T′ faced away from the on-coming traffic, in which case the beam and cable will swing away from post P2 in the direction of traffic flow. The beam B carries the thimble 40 to engage over the bit T′ where it can be secured by a latch. When opened, the barrier beam and cable extend from the pivot post P1 and along the one side of the trafficway, as shown.

From the foregoing it will be understood that I have provided a manually operable trafficway barrier that can be securely anchored at opposite sides of the taffic-way, as as to be opened for passage of vehicles, or closed for preventing vehicle passage. The post and cable structure is extremely strong, reusable, and durable, the cable being flexible so as to conform to severe impact. As pointed out above, it is expected that certain replaceable parts will be damaged, and these parts are those which are considered to be expendable. Also, it is expected that the anchor blocks may be displaced by severe impact, in which case they are subject to being realigned and reset into proper position, as as circumstances require.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A vehicle barrier characterized by a beam retractably extending visibly across a trafficway and including;

a pivot post disposed on a vertical axis at one side of the trafficway and extending to a plate and an anchor on said vertical axis and spaced above the trafficway, a bit post disposed on a vertical axis at the other side of the trafficway and extending to a bit spaced above the trafficway in horizontal alignment with the pivot post at the one side of the trafficway, mounting means on the pivot post plate and including an adjustable plate rotatable on the pivot post and on the vertical axis thereof to position and align bearings carried by said adjustable plate on a transverse pivotal axis intersecting the vertical axis of the pivot post, a rigid beam carried at the one side of the trafficway by said bearings on the transverse pivotal axis of the mounting means and extending in a lowered position to the bit post at the other side of the trafficway, and operable toward a vertical position at the one side of the trafficway, and a cable loosely carried by the beam and secured to the anchor of the mounting means at the one side of the trafficway and disengageable over the bit at the other side of the trafficway, the cable being of substantial strength to receive vehicle impact.

2. The vehicle barrier as set forth in claim 1, wherein the bearings of the mounting means are frangible and thereby expendable upon severe vehicle impact.

3. The vehicle barrier as set forth in claim 1, wherein the beam is a thin walled expendable member within which the cable is flexibly carried and the bearings of the mounting means are frangible and thereby expendable upon severe vehicle impact.

4. The vehicle barrier as set forth in claim 1, wherein the adjustable plate of the mounting means rotatably overlies the first mentioned pivot post plate and is adjustable on said vertical axis by at least one fastener engaged through a slot therethrough to position the transverse pivotal axis and to align the beam and cable with the bit on the bit post.

5. The vehicle barrier as set forth in claim 1, wherein at least one or both the pivot post and bit post are set into anchor blocks, wherein an end of the cable is secured to the anchor at the pivot post and is looped to engage over the bit of the bit post, wherein the beam is tubular and within which the cable is carried, wherein the mounting means is comprised of a yoke pivotally carried on the transverse axis by said bearings and having a member to carry the beam, and wherein the bearings of the mounting means are frangible and thereby expendable upon severe vehicle impact.

6. The vehicle carrier as set forth in claim 1, wherein at least one or both the pivot post and bit post are set with attached reinforcement bars within concrete anchor blocks poured above and below grade of the trafficway, wherein the cable is doubled and its opposite ends secured to the anchor of the pivot post and with a looped portion at the end of the beam to engage over the bit of the bit post, wherein the beam is tubular and within which the doubled cable is carried, wherein the mounting means is comprised of a yoke pivotally carried on the transverse axis by said bearings and by a socket member in which the beam is replaceably carried, wherein the beam is thin walled expendable tubing within which the cable is flexibly carried and the bearings of the mounting means are frangible and thereby expendable upon severe vehicle impact, and wherein the adjustable plate of the mounting means rotatably overlies the first mentioned pivot post plate and is adjustable on said vertical axis by at least one fastener engaged through a slot therethrough to position the transverse pivotal axis and to align the beam and cable with the bit on the bit post.

* * * * *